United States Patent [19]

LaHaye et al.

[11] Patent Number: 4,892,139

[45] Date of Patent: Jan. 9, 1990

[54] MEANS AND METHOD FOR PREVENTING UNWANTED ACCUMULATION IN HEAT EXCHANGERS

[75] Inventors: Paul G. LaHaye, Cape Elizabeth, Me.; Eric R. Norster, Holliston, Mass.

[73] Assignee: H.P.S. Merrimack Corp., South Portland, Me.

[21] Appl. No.: 217,454

[22] Filed: Jul. 11, 1988

[51] Int. Cl.[4] ..... F28G 1/00

[52] U.S. Cl. ..... 165/95; 110/216; 122/379; 122/DIG. 13; 165/5

[58] Field of Search ..... 122/379, DIG. 13; 110/216, 217; 165/95, 5

[56] References Cited

U.S. PATENT DOCUMENTS

| | | | |
|---|---|---|---|
| 3,503,348 | 3/1970 | Dvirka | 110/216 |
| 3,656,440 | 4/1972 | Grey | 110/216 X |
| 4,279,625 | 7/1981 | Inculet et al. | 110/216 X |

*Primary Examiner*—Edward G. Favors

*Attorney, Agent, or Firm*—Wolf, Greenfield & Sacks

[57] ABSTRACT

A heat exchange element in the form of a tube, lies in a particulate laden gas flow and is charged with an electrostatic charge of the same polarity as an electrostatic charge on particles suspended in the gas flow, in order to prevent accumulation on any part of the heat exchange element which would interfere with the rate at which thermal energy can be transferred through the heat exchange element or restrict flow of gas through the heat exchanger.

18 Claims, 3 Drawing Sheets

MEANS AND METHOD FOR PREVENTING UNWANTED ACCUMULATION IN HEAT EXCHANGERS

BACKGROUND OF THE INVENTION

In many parts of the world including the U.S. there are enormous coal reserves that are becoming increasingly more important in connection with the generation of electric power. In one method of using coal reserves, coal is mixed with residual oil and fired in suspension in a refractory-lined chamber. Ceramic heat exchangers are then used to remove heat from the combustion gases laden with particles that flow past a surface of the heat exchangers. Often the heat exchange surfaces in the gas flow path are narrow in the range of from one to eight inches.

It is well known in the art that particle laden gas flow over heat exchange surfaces can cause unwanted accumulation on the surfaces which can restrict the flow of gas through a heat exchanger, and/or in less severe cases, can interfere with the rate at which thermal energy can be transferred through the heat exchange surface. Such unwanted accumulations can greatly affect the efficiency of heat exchange elements and have been a problem in the past. It has been well recognized in the industry that the deposition rate of coal ash on the heat transfer surfaces, i.e., tubes and steam generators and the like is to a large extent the function of the ash fusion point, the temperature of the gas entering the heat exchanger and the temperature and type of surface of the tubes. To some extent ash deposits can be a function of the physical configuration of the ash particles, tube spacing, gas velocities and tube arrangement in heat transfer devices. Ash could greatly affect the performance of whole systems. If such deposits could be prevented or lessened, there could be significant increases in efficiency in power generation. For example, externally fired gas turbines become much more efficient if ash accumulation can be prevented. Such systems are known and incorporate a heat exchanger combined with a suitable combustor to replace the internal combustion systems within a conventional open-cycle gas turbine. The heat exchanger accepts air at pressure at the compressor discharge conditions and heats this compressed air to a slightly higher temperature than the required turbine inlet temperature, then returns the air to the turbine section. Clean air delivered to the turbine replaces the products of combustion in the conventional internally-fired cycle thereby appreciably extending the service life of the turbine section. Static ceramic tubes are preferred for use in the heat exchangers exposed to high temperature corrosive effects of the impurities in the fuel. Designed packages for turbine cycles in the range of from 5 kilowatts to 1,350 megawatts are possible.

SUMMARY OF THE INVENTION

It is an object of this invention to provide means and methods to prevent unwanted accumulation of particles from forming deposits on a heat transfer element surface by the use of electrostatic charges imposed on the element and a particulate gas flow, in preferred manners to obtain efficient operation of heat exchange elements.

Still another object of this invention is to provide means and method in accordance with the preceding object which can be used in a wide variety of applications at minimum cost and maximized efficiency.

According to the invention a method of preventing or lessening the accumulation of particulate matter on a heat exchanger surface element is provided. A gas stream laden with particles is passed over the surface of the element while maintaining an electrical charge of a first polarity on the particles in the gas stream. An electrical charge of the same polarity as the first charge is maintained on the heat exchange surface element. Because the electrostatic charges which may be naturally or artificially produced, have the same polarity, the heat transfer element surface repels the particles in the gas stream with sufficient force to overcome the inertia inparted to the particles by the gas stream flowing through the heat exchanger. Thus particles of dust, ash or other particulate matter in the gas stream are deflected away from the heat exchanger surface elements or tubes in the preferred embodiment caused to flow through the heat exchanger in the gas stream without physically contacting the heat exchange transfer elements and surfaces of the heat exchanger. This prevents build up and accumulation of particles that could restrict or clog the gas flow and/or prevent efficient heat transfer to the surface of the elements.

A heat exchanger in accordance with the invention has a first flow path for flow of a particular ladened gas stream, a second flow path for heat transfer to a second fluid flow and means for maintaining an electrical charge of a first polarity on the particles in the gas stream as well as means or maintaining the same polarity on the heat transfer surface portion of the heat exchanger.

In the preferred embodiment, the heat exchanger is formed of ceramic tubes maintained in position by a tube sheet. A dielectic material is used to isolate the tubes while maintaining an electrostatic charge thereon. Preferably, the particles in the gas stream are charged and the heat exchange surface is charged naturally or by suitable electrical apparatus.

It is a feature of this invention that an optimum heat exchange element surface condition can be maintained in the exchange apparatus over an extended period of operation when the surface is exposed to a gas or vapor stream laden with particulate in accordance with the present invention. While negative charges are preferred as the same polarity charges on the particles and exchanger element, positive charges can be used.

DESCRIPTION OF THE DRAWINGS

The above and other features, objects and advantages of the present invention will be better understood from a review of the attached drawings in which.

DESCRIPTION OF PREFERRED EMBODIMENTS

Figure 1:
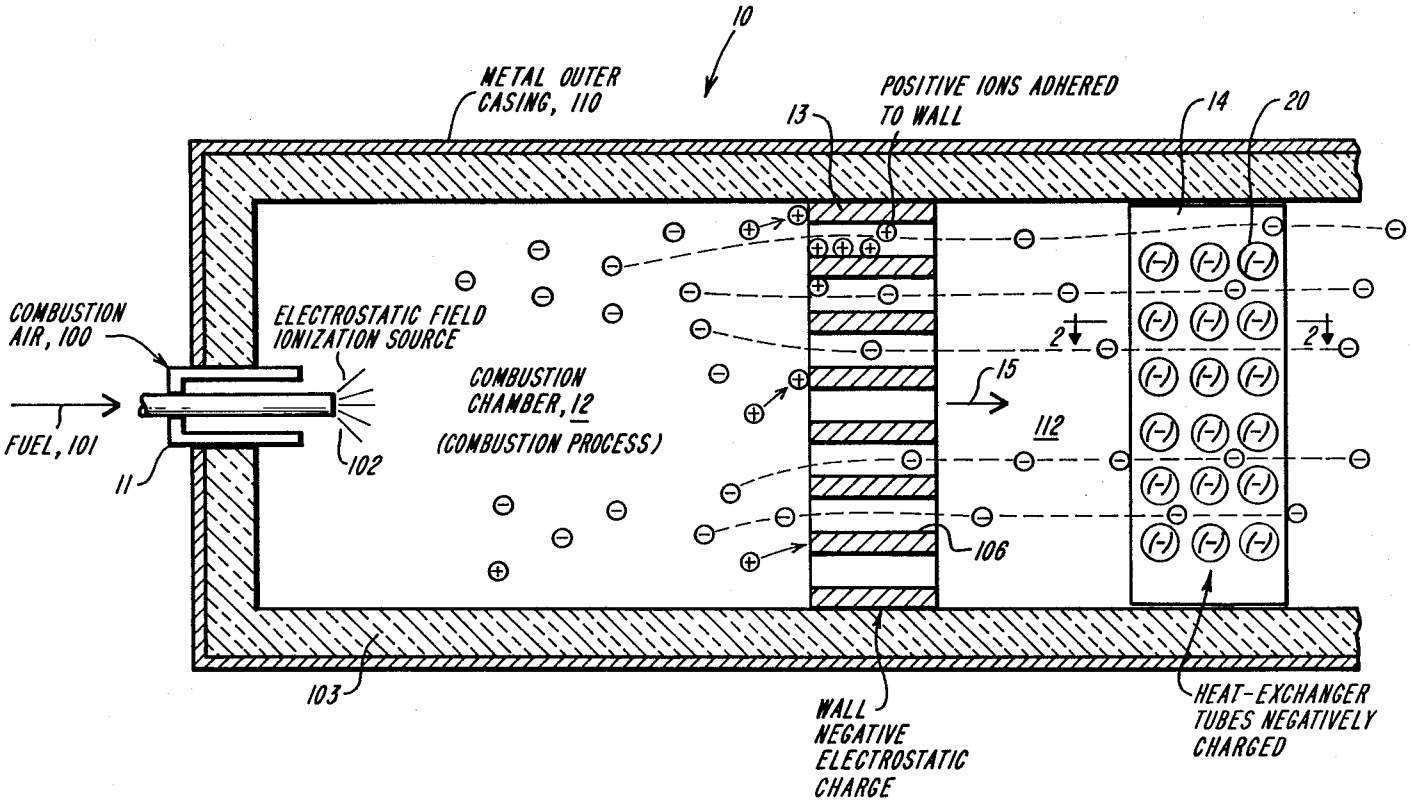
FIG. 1 is a semi-diagrammatic, cross-sectional view of a heat exchanger system in accordance with the present invention.
Figure 2:
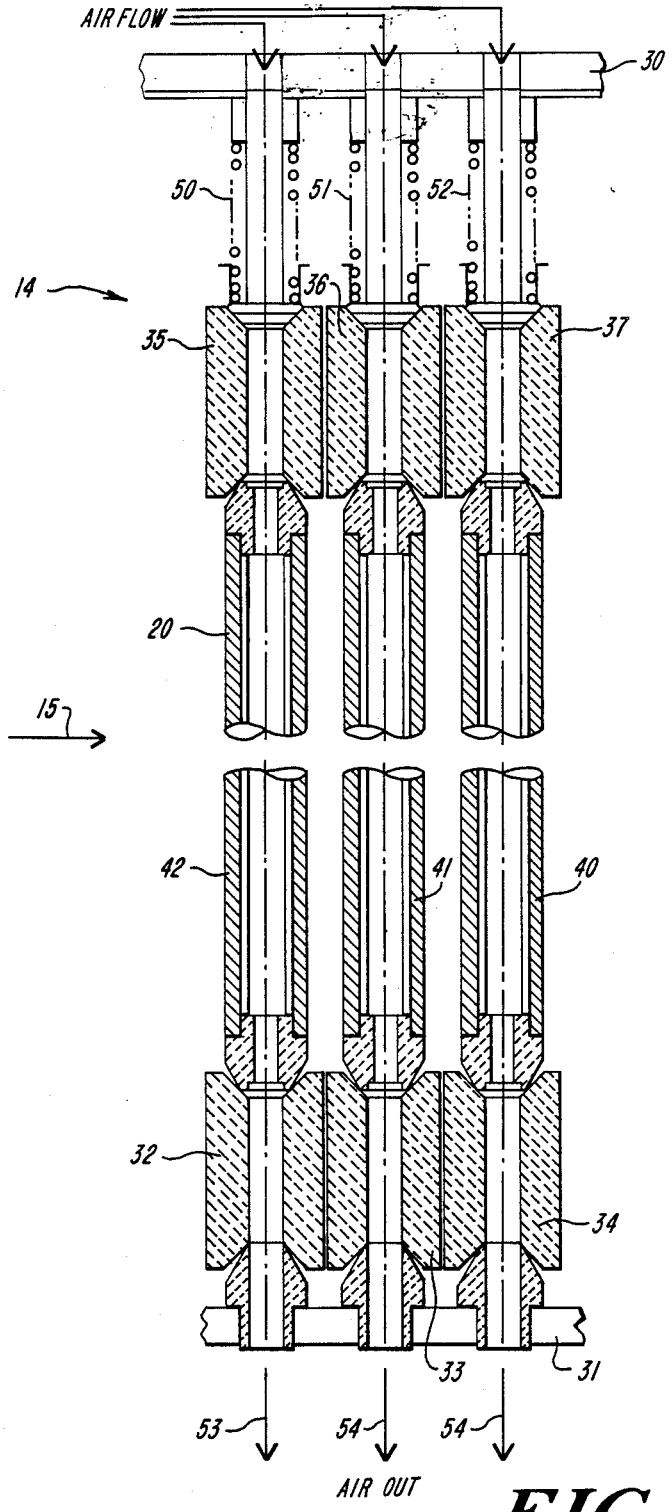
FIG. 2 is a top, cross-sectional view thereof taken through line 2—2 of FIG. 1.

With reference now to FIGS. 1 and 2, a heat exchanger system in accordance with the present invention is illustrated generally at 10 and comprises a combustion nozzle arrangement 11, combustion chamber 12, electrostatic negative ionization wall 13 and a heat exchanger section 14 through which a gas flow 15 of particulate ladened gas flows from the combustion chambers 12 generated by the combustion of the fuel. The flow through the apparatus is induced by means external to the apparatus such as an electric motor driven blower not shown . The heated gas flow 15 exchanges heat at the surface of the tubular elements 20 (all of which are identical) of the heat exchanger 14 best shown in FIG. 2.

The heat exchanger 14 can be of any design but in one embodiment shown comprises tube sheets 30, 31 mounting hexagonal, cross-section tubular mounting elements 32, 33, 34 on one side and 35, 36, and 37 on another side. These hexagonal elements are electrical and thermal isolators for the heat exchange tubes 40, 41, and 42. The hexagonal element 32–37 preferably have dielectric properties with electrical conductivity lower than $10^{-7}$ mho/meter or dielectric coefficient not greater than 20 in order to effectively, heat and electrically isolate the tubes. All the ceramic elements of the tubes and members 32–37 can be of conventional materials such as silicon nitride, silicon carbide, alumina, and the like. The heat exchange elements or tubes can be finned or smooth surfaced and may also be fabricated of other heat exchange materials including metals such as copper, stainless steel or the like. Preferably the materials of the heat exchanger elements have a high thermal conductivity of at least 100 BTU/hr/ft° F since the deposits often have poor heat conducting properties as compared with the heat exchanger elements.

The tubes are preferably held aligned by spring pressure such as by springs 50, 51, 52 between the tube sheets as known in the art. Air flow in the direction of arrows 53, 54 and 55 removes the heat conducted through the tubes 40, 41 and 42 principally by convection internally.

The flow of particulate ladened combustion air 15 passes over the outside surface of the ceramic tubes. The ceramic tubes can be spaced apart a distance of one inch as at 60, although distances of from one to eight inches are preferred although larger distances can be used. Because there are spaces which can be narrow, any particulate build up would have the effect of restricting flow and thus restricting heat transfer as well as depositing on the surface and resulting in diminished or blocked heat transfer to the surface of the heat exchange elements. This is particularly so where finned tubes are used, since the spaces between the fins can fill up with thermally poor transmitting ash or other particulate matter.

Ash build up is a particular problem where the combustion gas flows result from combustion of coal oil slurries, coal water slurries, inefficiently burned hydrocarbon materials, lignite, biomass, city refuse combustion products or products of coal gasification process and the like. AAs best seen in FIG. 1, combustion air can be provided at 100 with a coal, oil or other fuel inlet at 101 for fuel to be combusted at a nozzle tip 102 in the combustion chamber 12. The nozzle tip 102 can be electrostatically charged by an ioniziation source such as a charging electrode, corona discharge or balloelectric charging as known in the art.

Preferably, the combustion chamber is lined with an insulating material such as fire brick 103 which prevents dissipation of an electrical charge at the burner tip 102. Similarly, the insulation 103 can prevent dissipation of charge from a wall 110.

An electrostatic charge producing wall 13 can be a simple disk which fills the circular passageway of the insulation member 103 so that all combustion materials in the flow 15, pass through the wall 13. The wall itself has a negative charge so as to attract all positive ions in the particles as they impinge on the wall during flow therethrough. In the preferred embodiment, the wall is a two inch thick disk of silicon carbide having passageways 106 therein with diameters of approximately one inch and with 100 passageways 106 provided. After passage to the wall and removal of the positive ions, the gas flow in a portion 112 of the combustion chamber now has negatively charged particles. The heat exchange tubes are provided with a negative charge by means such as an external power source or charge transfer from the gas stream. Thus, the negatively charged tubes which are of the same polarity as the particulate matter, cause the particles to avoid contacting the surface since they repel the particles during flow through the system 10.

In a specific example of this invention, the heat exchanger comprises 18 ceramic tubes in a matrix spaced one inch apart, the diameter of the combustion chamber 12 is 15 inches, fuel and combustion air provide a flow of gas 15 at a rate of 30,000 lbs/hr with the particular matter suspended in the flow being three percent of the total weight of the gas flow.

It is found that operation for 20 periods of approximately 12 hours time with combustion of 200 lbs/hr of fuel entering the heat exchanger at gas total inlet temperatures of from 1340° F. (1000° K.) to 2800° F. (1800° K.) results in substantially no ash or other build up on the heat exchange surfaces of the tubes, thus maintaining the clean efficiency of the exchanger 14.

In some embodiments, the wall 13 can have walls, baffles or obstructions therein to physically cause impingement of heavy particles and allowing such particles to drop to the bottom of the combustion area and be removed.

The polarities chosen for the particles and heat transfer element surface can be either negative or positive providing they are both the same. The ionization wall 13 also serves as a separator to remove the very large particles from the gas stream. The wall can be designed to mechanically separate or remove the very large particles as desired. A mechanical inertial separating means can be provided for example by a series of right angle turns for the gas stream.

The fuel entering the chamber 12 can have a negative charge imposed by an atomizer as in electrostatic paint spraying apparatus as commonly used in the industry. The combustion gas in the stream 15 can have the electrostatic charge imposed by the ionization wall 13 as well as by the ionization source at the nozzle 102 or either of them. In some cases the combustion gases can be charged by other means such as naturally occuring charges, or use of seeding combustion products which add a negative charge to the particles. For example, it is known that combustion of a gas stream carrying magnesium, can result in negatively charged particles in the combustion stream. This can be used in place of or to supplement an ionization wall or other electrical means.

Figure 3:
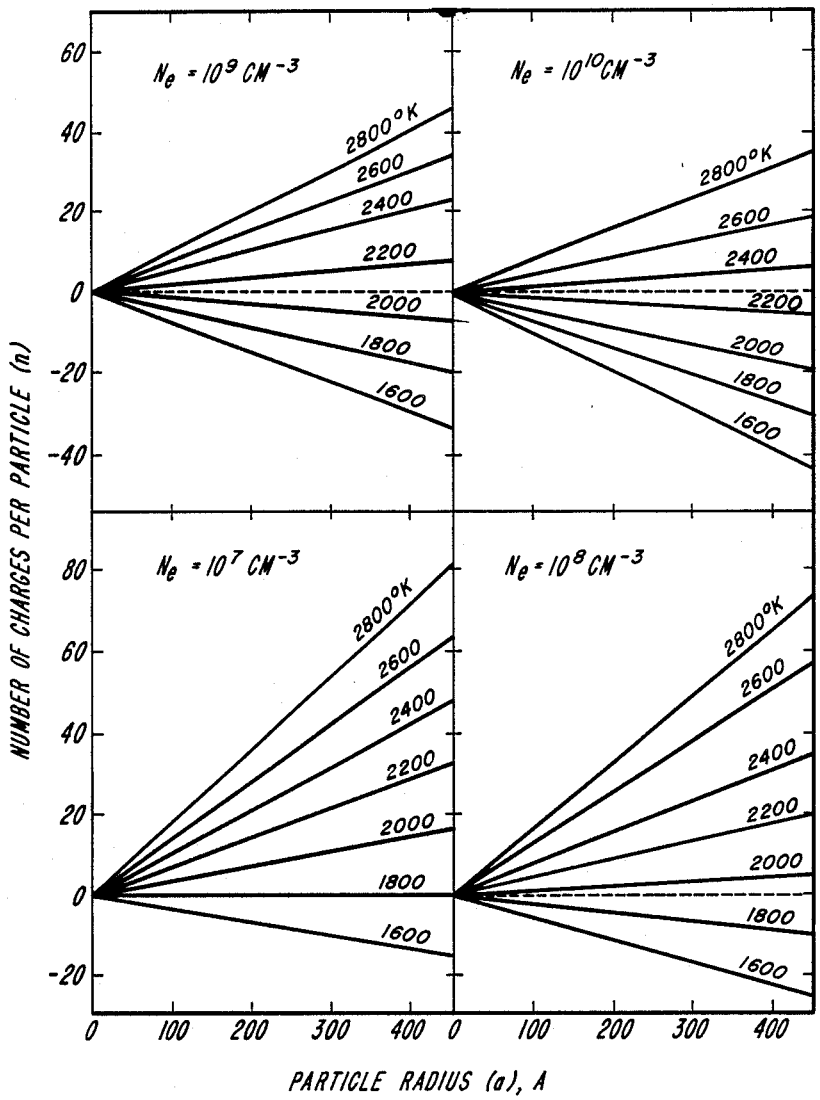
FIG. 3 is a graph illustrating naturally occuring charges formed during combustion.

Although it is preferred to use the combustion chamber with the ionization wall 13 alone or with an ionizing nozzle 102 alone, or both together, to produce the electrical charge on the particles in the gas stream, other means and methods can be used to create the charge. In such cases, one or both of the nozzle ionizer at 12 or wall 13 may be eliminated. FIG. 3 shows graphite particles charged by combustion means during normal combustion in the combustion chamber 12. Ø equals the thermionic work function. In FIG. 3 $N_e$ equals the electron particle concentration at varying temperature and size is shown. Thus at high temperature of combustion, positive charges are created. For example at 2800° K. at a particle radius of 400° A, about 40 to 70 positive charges per particle are created during combustion depending on electron concentration.

In some cases, the ionization wall can be grounded to provide a means for preventing excess build up which may cause arcing of the electrostatic charge to the ground. A controlled bleed of current from the heat transfer surface element and/or the electrostatic wall can be used as desired. The form of the ionization wall can vary greatly and can be rectangular, square or other configurations rather than a disc, depending on the furnace configuration. In some cases, no ionization wall is used and the particles are charged by combustion or other means.

Particulate ladened fuels and combustion gases resulting therefrom include coal-oil mixtures as for example shown in Table A. Table A further shows spectro ash analysis and sieve size of materials in a typical combustion flow.

Preferably the flow of particles over the exchanger is at a flow rate of from 15 to 200 ft/sec of a gas having 0.2 to 15.0 percent by weight of potentially clogging particles in a size range of from 2 to 50 microns. This gas stream can be any particle bearing gas stream. Preferably, the charge on the particles in the gas stream is substantially uniform in the flow. Thus, it is easier to control the nature of clogging and fouling of the heat exchanger when uniformly charged gas flow particles are used.

The fuel delivery nozzle end 102 has an ionization field imposed thereon s that the desired polarity charge can be imposed on fuel particles leaving the charged nozzle prior to combustion. Voltages in the range of 100 to 6,000 volts are preferably used but the break-down or arcing voltage of from 100 volts to 13,000 volts may be used.

TABLE A

| | From Hague International | |
|---|---|---|
| | OIL | COAL |
| Ash | 0.10% | 6.78% |
| Water Content | 2.0% | 1.46% |
| BTU/lb. (HHV) | 18,844 | 12,784 |
| Specific Gravity @160° F. | 0.87 | — |
| Volatile | — | 34.00% |
| Fixed Carbon | | 53.67% |
| Ultimate | | |
| Carbon | 85.5% | 78.6% |
| Hydrogen | 10.4% | 7.2% |
| Nitrogen | 0.58% | 0.77% |
| Oxygen | 0.41% | 0.54% |
| Sulfur | 0.79% | 4.09% |
| Chlorine | — | — |
| Spectro Ash Analysis | | |
| Calcium Oxide | 6.3% | 5.0% |
| Iron Oxide | 7.1% | 7.1% |
| Sodium & Potassium Oxide | 1.0% | 0.8% |
| Magnesium Oxide | 0.9% | 2.0% |
| Phosphorous ($P_2O_5$) | 0.8% | 0.7% |
| Sulfates | 0.5% | 2.1% |
| Silica & Other Insolubles | Balance | Balance |
| Sieve Size | | |
| Retained on $60 | | 0% |

TABLE A-continued

| | From Hague International | |
|---|---|---|
| | OIL | COAL |
| Retained on #100 | | 0.5% |
| Retained on #200 | | 2.0% |
| Retained on #325 | | 26.5% |
| Passing #325 | | 70.0% |
| Loss | | 1.0% |

[a]The coal-oil mixture (COM) was a nominal 56% coal–44% oil.

What is claims is:

1. A method of preventing restrictive accumulation of particulate matter on a heat exchanger element while passing a gas stream laden with particles over said element, said method comprising maintaining an electrical charge of a first polarity on said particles, maintaining an electrical charge of the same polarity as said first charge on said heat exchange element.

2. A method in accordance with the method of claim 1 wherein said gas stream is passed at a flow rate of from 15 to 200 ft/sec at said heat exchange element and said particles comprise combustion products having particle sizes of from 2 to =microns present in amounts of from 0.2 to 15.0 percent by weight in said gas stream.

3. A method in accordance with the method of claim 2 wherein said charge is maintained on said heat exchange element and said gas stream is exposed to an ionization means to obtain said charge of said first polarity.

4. A method in accordance with the method of claim 3 wherein said gas stream follows a tortuous path to remove large particles thereof.

5. A method in accordance with the method of claim 4 wherein said gas stream is derived from the combustion of a coal-oil mixture.

6. A method in accordance with the method of claim 4 wherein said first polarity is an electrostatic charge to cause repelling of like charges and thus prevent particle impacting heat transfer surfaces of the heat exchange element which fouls the surface by causing unwanted build up of deposits on the element.

7. A method in accordance with the method of claim 2 wherein said gas stream is passed over said heat exchange element which is in the form of a heat exchange tube.

8. A method in accordance with the method of claim 7 and further comprising removing a heated fluid from said heat exchange tube.

9. A method of imparting a charge to particles in a gas combustion stream prior to entering into a heat exchange matrix, said method comprising flowing said gas stream through a wall containing passageways designed to cause the gas stream to take drastic changes in direction so as to eliminate the largest particles by mechanical or inertial means, said gas stream being passed at a rate of from 15 to 200 ft/sec.

10. A method in accordance with the method of claim 9 wherein said charge is a negative charge.

11. A method in accordance with the method of claim 9 wherein said combustion gas has a uniform voltage imposed in the range of from 100 volts to the breakdown or arcing voltage.

12. A method in accordance with the method of claim 11 and further comprising monitoring said wall to define a constant charge.

13. In a heat exchanger, having tubular heat exchange elements, the improvement comprising a means for activating the elements by providing an electrostatic charge to said elements which charge is of the same polarity as that of the particles in a gas stream to be passed over said heat exchange element.

14. A system for preventing particular build up on heat exchange surfaces of a heat exchanger, said system comprising, a first wall means for imparting an electrostatic charge of a first polarity to a gas stream laden with particles passed therethrough, and heat exchange surfaces located to receive said gas stream and having means for maintaining an electrostatic charge thereon of the same polarity of said first mentioned electrostatic charge.

15. A system in accordance with claim 14 and further comprising particulate laden combustion gas having a particle content of 0.2 to 15.0 percent by weight with said gas stream flowing of a rate of from 15 to 200 ft/sec.

16. A system in accordance with the system of claim 15 wherein said heat exchange surfaces are formed by tubes and said tubes are electrically and thermally isolated by means of tubular hexagonal mounting blocks extending from a tube sheet locating a plurality of heat exchange tubes.

17. A system in accordance with claim 14 and further comprising a fluid delivery nozzle having a means for imposing an ionization field thereon to obtain a desired polarity charge on fuel particles leaving said nozzle prior to combustion.

18. A system in accordance with claim 17 wherein said nozzle has a high voltage in the range of from 100 to the break-down or arcing voltage of the apparatus.

* * * * *